US007856836B2

(12) United States Patent
Aoki

(10) Patent No.: US 7,856,836 B2
(45) Date of Patent: Dec. 28, 2010

(54) REFRIGERATING AIR CONDITIONING SYSTEM

(75) Inventor: Masanori Aoki, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 386 days.

(21) Appl. No.: 11/662,519

(22) PCT Filed: Jul. 24, 2006

(86) PCT No.: PCT/JP2006/014541

§ 371 (c)(1),
(2), (4) Date: Mar. 12, 2007

(87) PCT Pub. No.: WO2007/013382

PCT Pub. Date: Feb. 1, 2007

(65) Prior Publication Data

US 2009/0266093 A1 Oct. 29, 2009

(30) Foreign Application Priority Data

Jul. 26, 2005 (JP) ..... 2005-215878

(51) Int. Cl.
*F25D 21/06* (2006.01)
*F25D 21/02* (2006.01)

(52) U.S. Cl. ..... 62/155; 62/156; 62/140

(58) Field of Classification Search ..... 62/155, 62/156, 151, 140, 234
See application file for complete search history.

(56) References Cited

U.S. PATENT DOCUMENTS 4,694,657 A 9/1987 Vaughn (Continued)

FOREIGN PATENT DOCUMENTS

JP 57-164245 A 10/1982

(Continued)

OTHER PUBLICATIONS

International Search Report for PCT/JP2006/314541 dated Oct. 24, 2006.

(Continued)

*Primary Examiner*—Chen-Wen Jiang
(74) *Attorney, Agent, or Firm*—Buchanan Ingersoll & Rooney PC

(57) ABSTRACT

A refrigerating air conditioning system is provided with a refrigerant circuit which includes a compressor 3, an indoor heat exchanger 6, a first pressure reducing device 10, an outdoor heat exchanger 11, and a switching device 4 for switching a direction of a refrigerant flow between heating and cooling modes for supplying heat from the indoor heat exchanger 6. In the system, a refrigerant temperature detection sensor 14*c* of the outdoor heat exchanger 11 and an outdoor air temperature detection sensor 14*d* are provided for determining a state of a frost formed on the outdoor heat exchanger 11. Two types of defrosting inhibition time values $\tau 1$ and $\tau 3$ are allowed to be set in accordance with a previous defrosting time $\tau 2$ for continuously performing heating operation. A defrosting operation is performed by controlling the defrosting inhibition time value to be long when an amount of the frost formed on the outdoor heat exchanger 11 is determined to be small, and the defrosting inhibition time value to be short when the amount of the frost formed on the outdoor heat exchanger 11 is determined to be large.

7 Claims, 3 Drawing Sheets

| DEFROSTING TIME $\tau 2$ (MINUTE) | DEFROSTING INHIBITION TIME | |
|---|---|---|
| | $\tau 1$ (MINUTE) | $\tau 3$ (MINUTE) |
| $\tau 2 \leqq 3$ | 150 | 30 |
| $3 < \tau 2 \leqq 7$ | 90 | 20 |
| $7 < \tau 2 \leqq 10$ | 50 | 20 |
| $10 < \tau 2 < 15$ | 30 | 20 |
| $\tau 2 = 15$ | 20 | 20 |

U.S. PATENT DOCUMENTS

| | | | |
|---|---|---|---|
| 4,887,436 | A | 12/1989 | Enomoto et al. |
| 2004/0244389 | A1 | 12/2004 | Denvir |

FOREIGN PATENT DOCUMENTS

| | | | | |
|---|---|---|---|---|
| JP | 60-218551 | A | | 11/1985 |
| JP | 63-286676 | A | | 11/1988 |
| JP | 10-103818 | | | 4/1998 |
| JP | 11-023112 | A | | 1/1999 |
| JP | 2001-099529 | A | | 4/2001 |
| JP | 2002-318039 | | | 10/2002 |
| JP | 2003-065638 | A | | 3/2003 |
| JP | 2004-093020 | | | 3/2004 |
| JP | 2004116794 | A | * | 4/2004 |
| JP | 2004156858 | A | * | 6/2004 |
| WO | WO 2007/110908 | | | 10/2007 |

OTHER PUBLICATIONS

Supplementary European Search Report in corresponding Application No. 06781463.2—1266 dated Mar. 24, 2009.

Japanese Office Action issued Jul. 20, 2010 in corresponding Japanese Patent Application No. 2007-528444.

* cited by examiner

| DEFROSTING TIME τ2 (MINUTE) | DEFROSTING INHIBITION TIME | |
|---|---|---|
| | τ1 (MINUTE) | τ3 (MINUTE) |
| τ2≦3 | 150 | 30 |
| 3<τ2≦7 | 90 | 20 |
| 7<τ2≦10 | 50 | 20 |
| 10<τ2<15 | 30 | 20 |
| τ2=15 | 20 | 20 |

REFRIGERATING AIR CONDITIONING SYSTEM

TECHNICAL FIELD

The present invention relates to an air conditioning system for cooling and heating operations, and more particularly, to a refrigerating air conditioning system that performs defrosting upon accurate determination with respect to the frost formed on an outdoor heat exchanger.

BACKGROUND ART

In a generally employed refrigerating air conditioning system, for example, an air conditioner of heat pump type, an outdoor air temperature and a refrigerant vaporization temperature of the outdoor heat exchanger are detected, and the difference between those detected temperatures at a predetermined time elapsing from start of heating operation is compared with the difference between those temperatures at a predetermined time when the frost is expected to be formed. When the difference derived from the comparison exceeds a predetermined value, the system starts defrosting.

After an elapse of 20 minutes from start of heating operation, the refrigerating air conditioning system such as the air conditioner detects the outdoor air temperature and the refrigerant temperature, and the difference TA between those temperatures is stored. Then the difference TB between the detected temperatures after an elapse of a predetermined time period is calculated. When the difference between the TA and TB exceeds a set value TC, the defrosting is started. Depending on either high or low outdoor air temperature, the temperature difference TA is set to large or small reference value. Based on the reference value, the determination with respect to the frost formation may be made (for example, see Patent Document 1)

The refrigerating air conditioning system such as another air conditioner of heat pump type is provided with a refrigerant temperature sensor disposed between an indoor heat exchanger and a flow path switching valve, and an outdoor air temperature sensor. The system is designed to stop defrosting when the difference between values detected by the respective sensors becomes equal to or larger than a predetermined value.

The refrigerating air conditioning system like the air conditioner as described above is provided with a frost detection unit including a heat exchange temperature sensor for an outdoor heat exchanger and an air flow pressure sensor for detecting the pressure of air flowing through the outdoor heat exchanger. The system is designed to start defrosting when the temperature is equal to or lower than the predetermined temperature value, and the pressure is equal to or higher than the predetermined pressure value (for example, see Patent Document 2).

The refrigerating air conditioning system as another type of air conditioner is provided with an outdoor pipe temperature detection unit for detecting the temperature of the outdoor heat exchanger during heating operation, and an outdoor air temperature detection unit. The system is designed to determine the frost forming state based on the outdoor heat exchanger temperature, the outdoor air temperature, and a period for operating the compressor.

The system is designed to start defrosting when the outdoor heat exchanger temperature is maintained below the line L1 relative to the outdoor air temperature for 20 minutes or longer, and the compressor operating duration elapses 35 minutes (for example, see Patent Document 3).

Patent Document 1: Japanese Unexamined Patent Application Publication No. 57-164245 (pp. 2-3, FIGS. 3-5)

Patent Document 2: Japanese Unexamined Patent Application Publication No. 60-218551 (pp. 2-3, FIG. 1)

Patent Document 3: Japanese Unexamined Patent Application Publication No. 11-23112 (pp. 2-6, FIG. 3)

DISCLOSURE OF THE INVENTION

Problem to be Solved by the Invention

The generally employed air refrigerating air conditioning systems like the aforementioned air conditioners have the respective disadvantages. For example, in Patent Document 1, the temperature difference after an elapse of a predetermined period owing to fluctuation in the air conditioning load is not considered. The system fails to sufficiently conform to a model having the operation frequency of compressor variable. In Patent Document 2, the flow air pressure sensor is employed as the frost detection unit, which may require an expensive device. Accordingly the system has disadvantages of complicated arithmetic processing, and needs to discriminate the frost from the dust adhered on the heat exchanger. In Patent Document 3, determination with respect to the frost formation is made based on absolute values of the detected outdoor heat exchanger temperature and the outdoor air temperature. Under the condition at low outdoor air temperature and low humidity which hardly causes the frost formation, the system may erroneously start defrosting, thus reducing the heating operation efficiency and deteriorating the comfort.

The present invention is made to solve the aforementioned problems. It is an object of the present invention to provide a refrigerating air conditioning system that accurately detects the frost formed on the outdoor heat exchanger for improving the heating operation efficiency and comfort.

Means for Solving the Problem

According to the present invention, a refrigerating air conditioning system is provided with a refrigerant circuit which includes a compressor, an indoor heat exchanger, a first pressure reducing device, an outdoor heat exchanger, and a switching device that switches a direction of a refrigerant flow between heating and cooling, so as to supply heat from the indoor heat exchanger. In the refrigerating air conditioning system, refrigerant temperature detection means for the outdoor heat exchanger and outdoor air temperature detection means are provided to determine a state of a frost formed on the outdoor heat exchanger. Two types of defrosting inhibition time values $\tau 1$ and $\tau 3$ are allowed to be set in accordance with a previous defrosting time $\tau 2$ for continuous heating operation. The system is provided with a control device which controls a defrosting operation so that the defrosting inhibition time is set to be long when an amount of the frost formed on the outdoor heat exchanger is determined to be small, and the defrosting inhibition time is set to be short when the amount of the frost formed on the outdoor heat exchanger is determined to be large. The defrosting inhibition time values $\tau 1$ and $\tau 3$ are preliminarily set in accordance with the defrosting time value $\tau 2$.

Effect of the Invention

The above-structured refrigerating air conditioning system according to the present invention is capable of performing sufficient heating under the condition at the low outdoor air temperature that is likely to deteriorate the heating performance, and improving defrosting efficiency.

REFERENCE NUMERALS

Figure 1:
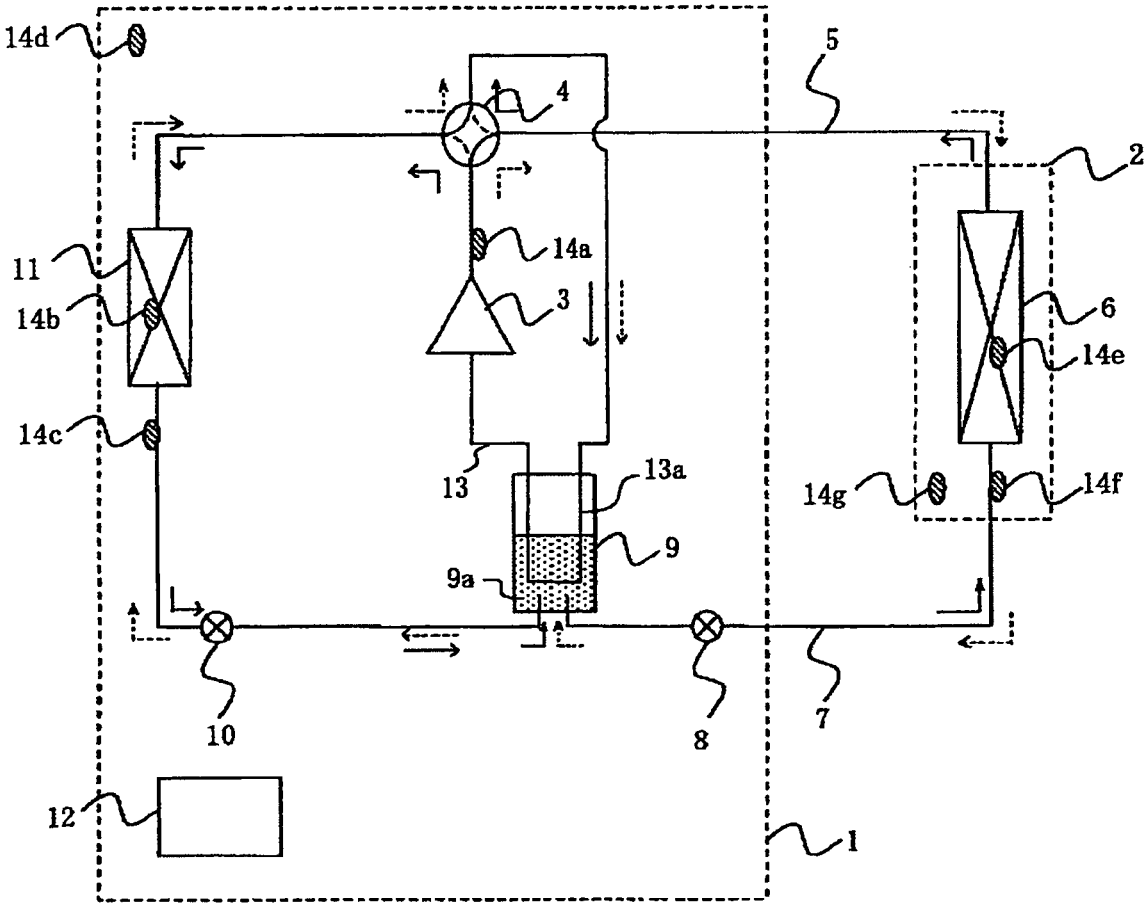
FIG. 1 is a refrigerant circuit diagram in a refrigerating air conditioning system according to Example 1 of the present invention.

1 outdoor unit
2 indoor unit
3 compressor
4 four-way valve
5 gas pipe
6 indoor heat exchanger
7 liquid pipe
8 second expansion valve
9 medium pressure receiver
9*a* heat exchange refrigerant
10 first expansion valve
11 outdoor heat exchanger
12 measurement control unit
13 intake pipe
13*a* through pipe
14*a* first temperature sensor
14*b* second temperature sensor
14*c* third temperature sensor
14*d* fourth temperature sensor
14*e* fifth temperature sensor
14*f* sixth temperature sensor
14*g* seventh temperature sensor

BEST MODE FOR CARRYING OUT THE INVENTION

Example 1

FIG. 1 is a refrigerant circuit (refrigerant circuit for refrigerating cycle) diagram representing a refrigerating air conditioning system according to Example 1 of the present invention. Referring to FIG. 1, an outdoor unit 1 includes a compressor 3, a four-way valve 4 which switches the flow of the refrigerant so as to switch the mode between heating and cooling, an outdoor heat exchanger 11, a first expansion valve 10 as a first pressure reducing device, a second expansion valve 8 as a second pressure reducing device, and a medium pressure receiver 9. An intake pipe 13 of the compressor 3 penetrates the medium pressure receiver 9 so as to allow the heat exchange between the refrigerant of a through pipe 13*a* of the intake pipe 13 and a heat exchange refrigerant 9*a* contained in the medium pressure receiver 9.

The compressor 3 is of a type in which its capacity is controlled by controlling the rotating number with an inverter. Each of the first and the second expansion valves 10 and 8 is an electronic expansion valve having the opening degree variably controlled. The outdoor heat exchanger 11 performs heat exchange with outdoor air fed by a fan (not shown). An indoor heat exchanger 6 is installed in the indoor unit 2. A gas pipe 5 and a liquid pipe 7 serve to connect between the outdoor unit 1 and the indoor unit 2. As a refrigerant for the refrigerating air conditioning system, R410A is employed as the HFC type mixture refrigerant.

The outdoor unit 1 includes a measurement control unit 12 and various temperature sensors 14. A first temperature sensor 14*a* is disposed at a discharge side of the compressor 3. A second temperature sensor 14*b* is disposed on a refrigerant flow path at an intermediate portion of the outdoor heat exchanger 11. A third temperature sensor 14*c* as an outdoor pipe temperature detection means is disposed between the outdoor heat exchanger 11 and the first expansion valve 10. The aforementioned temperature sensors measure refrigerant temperatures at the respective positions. A fourth temperature sensor 14*d* as an outdoor air temperature detection means serves as an outdoor air sensor that measures the temperature of outdoor air around the outdoor unit 1. The second and the third temperature sensors 14*b* and 14*c* function as refrigerant temperature detection means of the outdoor heat exchanger 11.

The indoor unit 2 includes a fifth temperature sensor 14*e*, a sixth temperature sensor 14*f*, and a seventh temperature sensor 14*g*. The fifth temperature sensor 14*e* is disposed on the refrigerant flow path at the intermediate portion of the indoor heat exchanger 6, and the sixth temperature sensor 14*f* is disposed between the indoor heat exchanger 6 and the liquid pipe 7. Each sensor measures the refrigerant temperature at the respective position. The seventh temperature sensor 14*g* measures the temperature of air admitted into the indoor heat exchanger 6. Incidentally, in the case where the heated medium as the load is other medium such as water, the seventh temperature sensor 14*g* measures the temperature of the inflow medium.

The second and the fifth temperature sensors 14*b* and 14*e* are capable of detecting the saturated temperatures of the refrigerant at high and low pressures, respectively by detecting the temperature of the refrigerant in the gas-liquid state at the intermediate point of the heat exchanger.

The measurement control unit 12 in the outdoor unit 1 controls the method of operating the compressor 3, flow path switching of the four-way valve 4, fan blowing capacity of the outdoor heat exchanger 11, opening degrees of the first and the second expansion valves 10 and 8, and the like based on the measurement results of the first to the seventh temperature sensors 14*a* to 14*g*, and the instruction of the operation from the user of the refrigerating air conditioning system.

The measurement control unit 12 performs control such that at the pressure reducing device (the first expansion valve 10 during cooling, and the second expansion valve 8 during heating) positioned upstream of the medium pressure receiver 9 with respect to the refrigerant flow, the degree of supercool at the outlet of the heat exchanger serving as a condenser becomes a predetermined target value, and at the pressure reducing device (second expansion valve 8 during cooling, and first expansion valve 10 during heating) positioned downstream of the medium pressure receiver 9, one of the degree of superheat of the refrigerant admitted into the compressor, the degree of superheat of the refrigerant at the outlet of the heat exchanger serving as the evaporator, the discharge temperature of the compressor, and the degree of superheat of the refrigerant at the outlet of the compressor becomes the predetermined target value.

An operation of the refrigerating air conditioning system will be described hereinafter. The system operation during heating operation will be described based on the refrigerant circuit diagram as shown in FIG. 1. During the heating operation, the flow path of the four-way valve 4 is set in the direction as indicated by the dashed line in FIG. 1. High temperature high pressure refrigerant gas discharged from the compressor 3 flows from the outdoor unit 1 via the four-way valve 4 into the indoor unit 2 via the gas pipe 5. It flows into the indoor heat exchanger 6 as the condenser, and condensed into liquid while radiating heat therein so as to be formed as the high pressure low temperature liquid refrigerant. The heat radiated from the refrigerant is applied to the load medium such as air and water at the load side for the heating operation. The high pressure low temperature refrigerant flows from the indoor heat exchanger 6 into the outdoor unit 1 via the liquid pipe 7, and becomes the gas-liquid refrigerant after being slightly decompressed by the second expansion valve 8. It then flows into the medium pressure receiver 9 where heat is applied to a low temperature refrigerant sucked into the compressor 3 so as to be cooled and flow out as liquid. Thereafter, it flows into the outdoor heat exchanger 11 serving as the evaporator for heat absorption, evaporation, and gasification. The heat exchange is performed between the resultant refrigerant and the high pressure refrigerant in the medium pressure receiver 9 via the four-way valve 4. It is further heated and sucked into the compressor 3.

The system operation during cooling operation will be described based on the refrigerant circuit diagram shown in FIG. 1. During cooling operation, the flow path of the four-way valve 4 is set as indicated by the solid line of FIG. 1. The high temperature high pressure gas refrigerant discharged from the compressor 3 flows into the outdoor heat exchanger 11 serving as the condenser via the four-way valve 4, and condensed to be liquid while radiating heat herein so as to become the high pressure low temperature refrigerant. The refrigerant flowing from the outdoor heat exchanger 11 is subjected to the heat exchange with the refrigerant sucked into the compressor 3 in the medium pressure receiver 9 and cooled after having the pressure slightly reduced by the first expansion valve 10. Thereafter, the pressure of the refrigerant is reduced to the low level by the second expansion valve 8 to form the gas-liquid refrigerant. The resultant refrigerant flows out of the outdoor unit 1 and enters into the indoor unit 2 via the liquid pipe 7. It then flows into the indoor heat exchanger 6 serving as the evaporator so as to absorb heat and evaporate to be gasified therein for supplying cold heat to the load medium such as air and water at the side of the indoor unit 2. The low pressure gas refrigerant flowing from the indoor heat exchanger 6 is discharged from the indoor unit 2 to flow into the outdoor unit 1 via the gas pipe 5. It is subjected to the heat exchange with the high pressure refrigerant in the medium receiver 9 and heated after having flowed via the four-way valve 4. Thereafter, it is sucked into the compressor 3.

Action and effect realized by the circuit structure and control according to Example 1 of the present invention will be described hereinafter. The action and effect derived from the through pipe 13*a* for the intake pipe 13 of the compressor 3 and a heat exchange refrigerant 9*a* in the medium pressure receiver 9 according to Example 1 will be described. In the medium pressure receiver 9, the heat exchange between the through pipe 13*a* for the intake pipe 13 of the compressor 3 and the heat exchange refrigerant 9*a* cools the refrigerant so as to be liquefied and flow out. During the cooling operation, the gas-liquid refrigerant flowing through the first expansion valve 10 flows into the medium pressure receiver 9 so as to be cooled and liquefied, and flow out. Accordingly, the enthalpy of the refrigerant that flows into the indoor heat exchanger 6 as the evaporator is lowered. This increases the refrigerant enthalpy difference in the evaporator, thus intensifying the cooling capability during the cooling operation.

The refrigerant sucked into the compressor 3 is heated to raise the intake temperature as well as the discharge temperature of the compressor 3. In the compression stroke of the compressor 3, more workload is required for the same pressure rise as the temperature of the refrigerant to be compressed becomes higher. Accordingly, the heat exchange between the through pipe 13*a* for the intake pipe 13 of the compressor 3 and the heat exchange refrigerant 9*a* in the medium pressure receiver 9 provides effects in view of the efficiency, that is, improved capability owing to the increased enthalpy difference of the evaporator, and increased compression work. In the case where the influence with respect to the improved capability owing to the increased enthalpy difference of the evaporator is relatively greater, the operation efficiency of the system is enhanced.

Upon the heat exchange between the through pipe 13*a* for the intake pipe 13 and the heat exchange refrigerant 9*a* in the medium pressure receiver 9, the gas refrigerant out of the gas-liquid refrigerant mainly comes in contact with the through pipe 13*a* for the intake pipe 13 to be condensed and liquified, where the heat exchange is performed. As the amount of residual liquid refrigerant in the medium pressure receiver 9 becomes smaller, the area, where the gas refrigerant of the heat exchange refrigerant 9*a* comes in contact with the through pipe 13*a* for the intake pipe 13, becomes larger, thus increasing the heat exchange amount. Conversely, as the amount of the residual liquid refrigerant in the medium pressure receiver 9 becomes larger, the area where the gas refrigerant of the heat exchange refrigerant 9*a* comes in contact with the through pipe 13*a* for the intake pipe 13 becomes smaller, thus reducing the heat exchange amount.

As the heat exchange is performed in the medium pressure receiver 9, the heat exchange amount autonomously fluctuates accompanied with the fluctuation of the operation state. As a result, the pressure fluctuation in the medium pressure receiver 9 is suppressed.

The heat exchange in the medium pressure receiver 9 provides the effect for stabilizing the operation of the system itself. In the case where the state of the low pressure side fluctuates to increase the degree of superheat of the refrigerant at the outlet of the outdoor heat exchanger 11 as the evaporator, for example, the pressure difference upon the heat exchange in the medium pressure receiver 9 is reduced. The resultant heat exchange amount is then reduced to have difficulty in condensation of the gas refrigerant. Therefore, the amount of the gas refrigerant in the medium pressure receiver 9 is increased, and the amount of the liquid refrigerant is reduced. The reduced amount of the liquid refrigerant moves to the outdoor heat exchanger 11 to increase the amount of the liquid refrigerant therein. This suppresses the increase in the degree of superheat of the refrigerant at the outlet of the outdoor heat exchanger, thus further suppressing operating fluctuation of the system. Meanwhile, in the case where the state of the low pressure side fluctuates to decrease the degree of superheat of the refrigerant at the outlet of the outdoor heat exchanger 11 as the evaporator, the temperature difference during the heat exchange in the medium pressure receiver 9 is increased. Therefore, the resultant heat exchange amount increases to allow the gas refrigerant to be easily condensed.

The amount of the gas refrigerant in the medium pressure receiver 9 is reduced, and the amount of the liquid refrigerant is increased. The increased amount of the liquid refrigerant moves from the outdoor heat exchanger 11 to decrease the amount of the liquid refrigerant therein. This suppresses the degree of superheat of the refrigerant at the outlet of the outdoor heat exchanger 11, thus further suppressing operating fluctuation of the system.

The effect for suppressing the fluctuation in the degree of superheat is obtained by autonomous fluctuation in the heat exchange amount accompanied with the operating fluctuation of the system resulting from the heat exchange in the medium pressure receiver 9.

The first expansion valve 10 is controlled such that the degree of intake superheat of the compressor 3 becomes a target value. The aforementioned control allows the degree of superheat at the outlet of the heat exchanger as the evaporator to be optimum to realize high heat exchange performance of the evaporator. This further allows the system operation to obtain appropriate refrigerant enthalpy difference, resulting in the operation with high efficiency.

Figure 2:
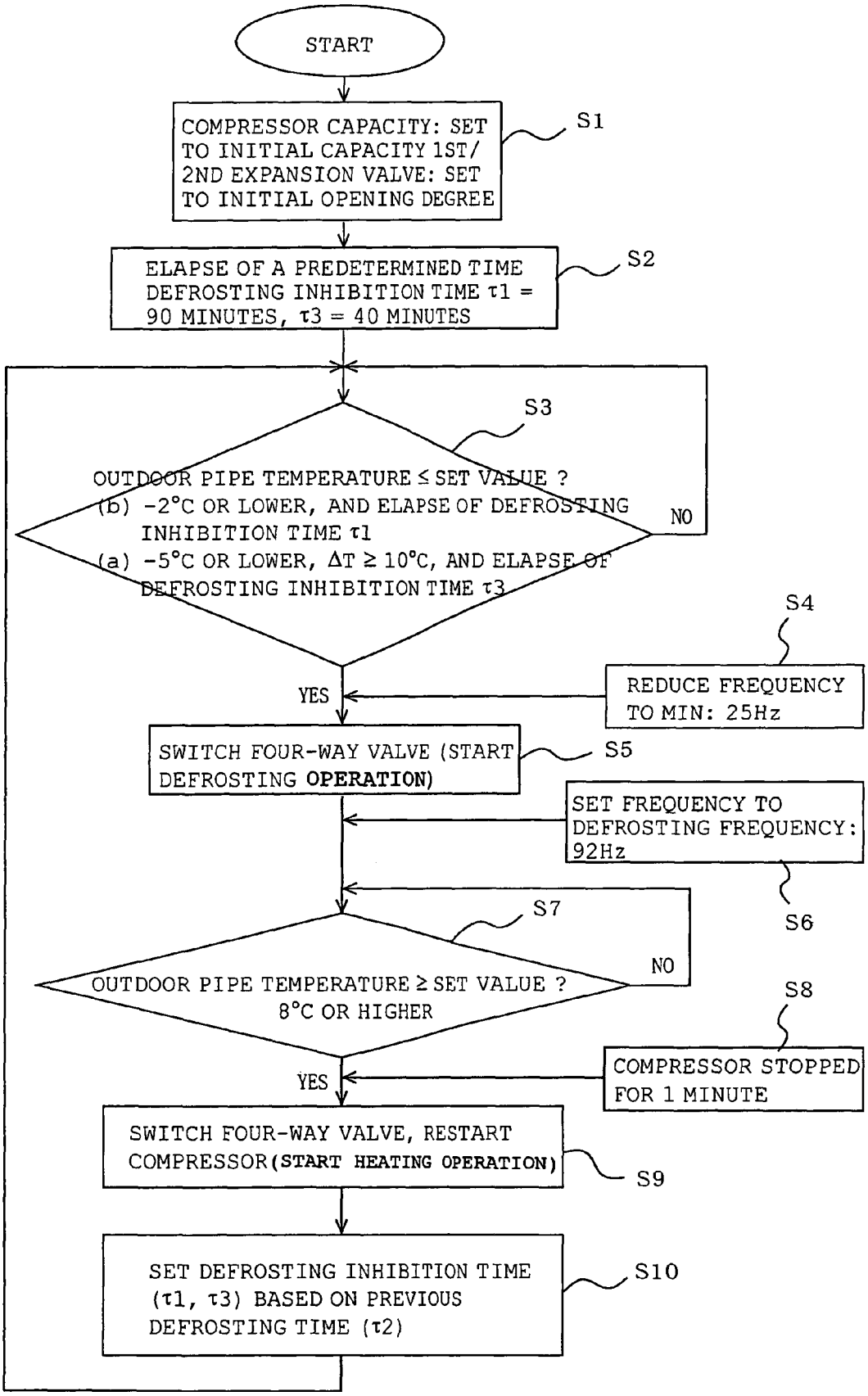
FIG. 2 is a flowchart of a routine for controlling defrosting operation in the refrigerating air conditioning system according to Example 1 of the present invention.

FIG. 2 is a flowchart representing an exemplary control operation for defrosting performed in the refrigerating air conditioning system. In this example, after start of heating operation, first in step S1, the capacity of the compressor 3, the opening degrees of the first and the second expansion valves 10 and 8 are set to initial values. Then in step S2, the operation is controlled as follows, after the elapse of predetermined defrosting inhibition times $\tau 1$ and $\tau 3$ (for example, $\tau 1$=90 minutes, $\tau 3$=40 minutes).

The capacity of the compressor 3 is basically controlled such that the room temperature detected by the seventh temperature sensor 14*g* of the indoor unit 2 becomes the value set by the user of the refrigerating air conditioning system.

Figures 3, 4:
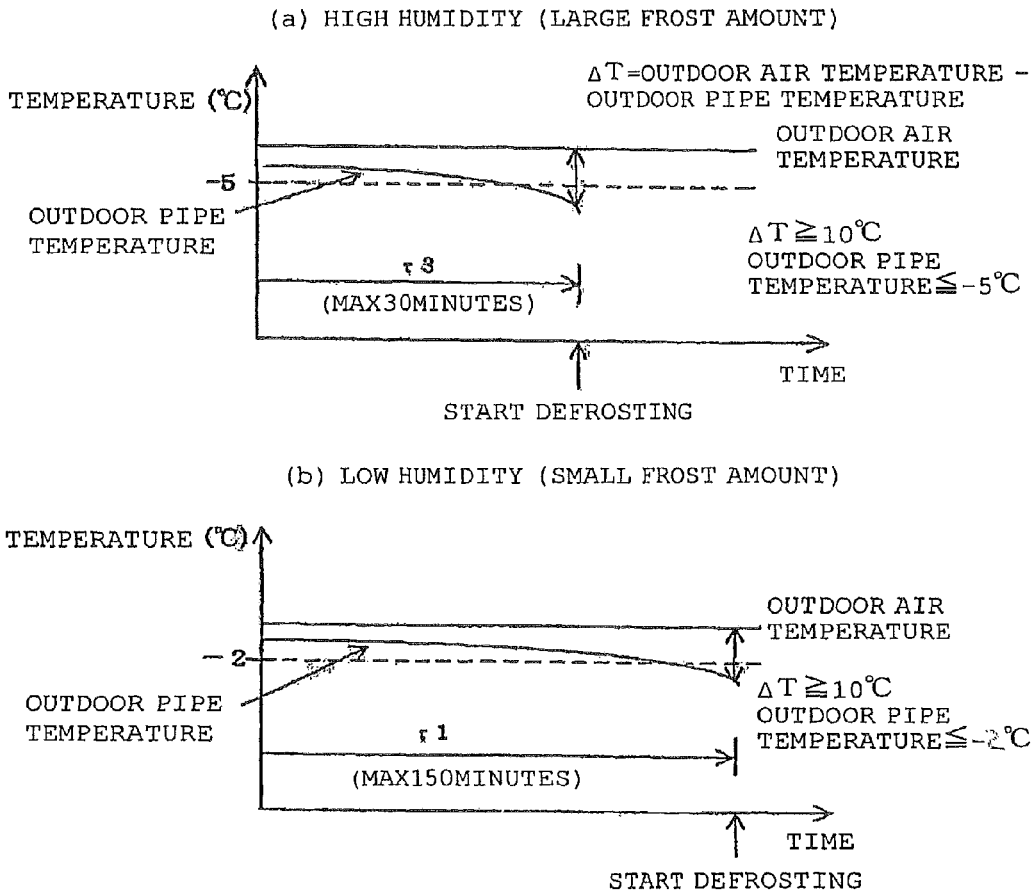
FIG. 3 is a view showing characteristics of the refrigerating air conditioning system according to Example 1 of the present invention during the defrosting operation in the case where the frost amount is determined to be large as shown in FIG. 3(*a*), and in the case where the frost amount is determined to be small as shown in FIG. 3(*b*).
FIG. 4 is a view showing a relationship between the defrosting time value $\tau 2$ and each of the defrosting inhibition time values $\tau 1$ and $\tau 3$, respectively in the refrigerating air conditioning system according to Example 1 of the present invention.

In step S3, the outdoor pipe temperature of the outdoor unit 1 detected by the third temperature sensor 14*c* as the refrigerant temperature of the evaporator is compared with a predetermined set value for the purpose of detecting the state of the frost formed on the outdoor unit 1 (especially the outdoor heat exchanger 11). As shown in FIG. 3(*a*), in the case where the outdoor pipe temperature is equal to or lower than the set value, for example −5° C. or lower, the outdoor pipe temperature is higher than the temperature detected by the outdoor air sensor (fourth temperature sensor 14*d*) by 10° C. or higher as indicated by the temperature difference ΔT between the outdoor air temperature and the outdoor pipe temperature, and the defrosting inhibition time $\tau 3$ (for example, 30 minutes) has elapsed, it is determined that a large amount of the frost is formed on the outdoor heat exchanger 11 as the evaporator. Then, the process proceeds to step S4 where the frequency of the compressor 3 is reduced to minimum, for example, 25 Hz, and the process proceeds to step S5 where the compressor frequency is reduced to the minimum frequency to start defrosting by switching the four-way valve 4. In step S6, the compressor frequency is fixed to the defrosting frequency, for example, 92 Hz. Then in step S7, the outdoor pipe temperature is compared with the predetermined set value. When the outdoor pipe temperature is equal to or higher than the set value (8° C. or higher), the process proceeds to step S8 where the compressor 3 is stopped for one minute. After the elapse of one minute, the process proceeds to step S9 where the compressor 3 is restarted by switching the four-way valve 4. In step S10, the defrosting inhibition time values $\tau 1$ and $\tau 3$ are set in accordance with the defrosting time in step 7 (previous defrosting time) $\tau 2$ so as to continue the heating by inhibiting defrosting.

With respect to the relationship between the defrosting time $\tau 2$ and the defrosting inhibition times $\tau 1$ and $\tau 3$, the longer the defrosting time $\tau 2$ becomes, the shorter the defrosting inhibition time ($\tau 1$, $\tau 3$) for the next cycle becomes, that is, the duration of the heating operation is reduced. In the case where the frost amount is estimated to be large, the defrosting is performed for relatively a short interval so as to improve the heating performance by recovering the performance of the evaporator faster. Conversely, in the case where the frost amount is estimated to be small, that is, the defrosting time $\tau 2$ is short, the defrosting inhibition time ($\tau 1$, $\tau 3$) for the next cycle is changed to be long such that the duration of the heating operation is increased for the purpose of improving the heating comfort. The exemplary values of the defrosting inhibition times $\tau 1$ and $\tau 3$ set in accordance with the defrosting time value $\tau 2$ are shown in FIG. 4. If the defrosting time $\tau 2$ is set to be short, for example, to the value equal to or shorter than 3 minutes, the $\tau 1$ is set to 150 minutes and $\tau 3$ is set to 30 minutes. If the defrosting time $\tau 2$ is set to be long, for example, to 12 minutes, the $\tau 1$ is set to 30 minutes and $\tau 3$ is set to 20 minutes. The defrosting time $\tau 2$ is defined to be set to 15 minutes at maximum. The values of $\tau 1$ and $\tau 3$ are set such that the relationship of $\tau 1 \geqq \tau 3$ is established.

The defrosting operation is performed with the same cycle as that of the cooling mode. The high pressure high temperature refrigerant discharged from the compressor 3 is fed to the outdoor heat exchanger 11 for performing the defrosting. Thereafter, the process returns to step S3 for executing the control routine.

Referring to FIG. 3(*b*), in step 3, in the case where the outdoor pipe temperature is equal to or lower than the predetermined set value, the temperature difference ΔT is lower than 10° C., and the defrosting inhibition time $\tau 1$ (for example, 150 minutes) has elapsed, for example, the outdoor pipe temperature becomes −2° C., the process proceeds to steps 4 and 5 to start defrosting. In this case, however, as the defrosting inhibition time $\tau 1$ is set to relatively a long period, the heating operation may be performed for a long period (150 minutes), thus improving the comfort.

The procedures from steps S5 to S10 are executed as described above.

Referring to the characteristic view in the case where the amount of frost formed on the outdoor heat exchanger 11 is large under the high humidified condition and the like as shown in FIG. 3(*a*), the evaporation temperature is gradually decreased owing to deterioration in heat transmission property caused by the frost formation, and reduction in air volume caused by the increase in the pressure loss. The difference between the outdoor air temperature and the outdoor pipe temperature becomes large. Therefore, when the defrosting inhibition time $\tau 3$ (30 minutes in this case) set based on the previous defrosting time $\tau 2$ is elapsed, the outdoor pipe temperature becomes negative (for example, −5° C. or lower), and the temperature is sufficiently lower than the outdoor air temperature (for example, the outdoor pipe temperature is lower than the outdoor air temperature by 10° C. or more), it is determined that the amount of the frost formed on the outdoor heat exchanger is large. The system operation is switched to the defrosting operation to melt the frost for the purpose of recovering the heat transmitting property of the outdoor heat exchanger serving as the evaporator.

Referring to the characteristic view in the case where the amount of frost formed on the outdoor heat exchanger 11 is small under the low humidified condition and the like as shown in FIG. 3(*b*), the decrease rate in the outdoor pipe temperature relative to the outdoor air temperature is small. In this case, when the defrosting inhibition time $\tau 1$ (150 minutes in this case) set based on the previous defrosting time τ2 has elapsed, and the outdoor pipe temperature becomes negative, for example, −2° C. or lower, the operation is switched to the defrosting operation. In this case, however, the defrosting inhibition time τ1 is set to a relatively long period. This allows the heating operation for a long period, thus improving the operation efficiency.

The effect realized by the defrosting operation during heating operation will be described. The defrosting operation for melting the frost formed on. the refrigerant pipe of the outdoor heat exchanger 11 by the refrigerant heat during heating operation is performed by feeding the refrigerant by switching the four-way valve 4 likewise the cooling operation. At this time, the frequency of the compressor 3 is fixed to the defrosting frequency which is higher than a rated frequency. As a result, the flow rate of the refrigerant discharged from the compressor 3 increases to further increase the flow rate of the refrigerant flowing into the outdoor heat exchanger 11 as the evaporator. This makes it possible to reduce the defrosting time.

The compressor 3 is temporarily stopped when switching the mode to the heating operation after completion of the defrosting. Thereby, the four-way valve 4 may be reliably switched at a small pressure difference between the high and low pressures. The resultant vibration and noise of the refrigerant may also be suppressed.

In the explanation, the third temperature sensor 14*c* is used as the means for detecting the refrigerant temperature of the evaporator during the heating operation. However, the same effect can, of course, be obtained by using the second temperature sensor 14*b* instead of the third temperature sensor or together therewith. In the explanation, the R410A is employed as the refrigerant, the same effect can, of course, be obtained by using other refrigerant.

The invention claimed is:

1. A refrigerating air conditioning system provided with a refrigerant circuit including a compressor, an indoor heat exchanger, a first pressure reducing device, an outdoor heat exchanger, and a switching device for switching a direction of a refrigerant flow between heating and cooling modes for supplying heat from the indoor heat exchanger, wherein:

refrigerant temperature detection means of the outdoor heat exchanger and outdoor air temperature detection means are provided for determining if an amount of frost formed on the outdoor heat exchanger is less than or equal to a predetermined value;

two types of defrosting inhibition time values τ1 and τ3 are allowed to be set in accordance with a correspondence to a plurality of ranges of a previous defrosting time τ2 for continuously performing heating operation; and a defrosting operation is performed by controlling the defrosting inhibition time values τ1 and τ3 to be longer, when an amount of the frost formed on the outdoor heat exchanger is determined to be less than or equal to the predetermined value, than the defrosting inhibition time values τ1 and τ3 when the amount of the frost formed on the outdoor heat exchanger is determined to be greater than the predetermined value.

2. The refrigerating air conditioning system according to claim 1, wherein the two types of defrosting inhibition time values τ1 and τ3 are correlated to establish a relationship of $\tau 1 \geqq \tau 3$;

when the amount of frost formed on the outdoor heat exchanger is determined to be less than or equal to the predetermined value, a determination with respect to switching to a defrosting operation is made based on an outdoor pipe temperature corresponding to a refrigerant temperature of the outdoor heat exchanger and the defrosting inhibition time τ1; and when the amount of frost formed on the outdoor heat exchanger is determined to be greater than the predetermined value, a determination with respect to switching to a defrosting operation is made based on the outdoor pipe temperature, an outdoor air temperature and the defrosting inhibition time value τ3.

3. The refrigerating air conditioning system according to claim 1 wherein a medium pressure receiver is provided between the indoor heat exchanger and the first pressure reducing device, and a second pressure reducing device is provided between the indoor heat exchanger and the medium pressure receiver.

4. The refrigerating air conditioning system according to claim 3, wherein a control device is provided, in which:

the pressure reducing device positioned downstream of the medium pressure receiver controls a flow of the refrigerant such that one of a degree of superheat of the refrigerant sucked into the compressor, the degree of superheat of the refrigerant at an outlet of the heat exchanger serving as an evaporator, a discharge temperature of the compressor, and the degree of superheat of the refrigerant discharged from the compressor becomes a predetermined target value; and the pressure reducing device positioned upstream of the medium pressure receiver controls the flow of the refrigerant such that the degree of supercool at the outlet of the heat exchanger serving as a condenser becomes a predetermined target value.

5. The refrigerating air conditioning system according to claim 2, wherein a medium pressure receiver is provided between the indoor heat exchanger and the first pressure reducing device, and a second pressure reducing device is provided between the indoor heat exchanger and the medium pressure receiver.

6. A refrigerating air conditioning system provided with a refrigerant circuit including a compressor, an indoor heat exchanger, a first pressure reducing device, an outdoor heat exchanger, and a switching device for switching a direction of a refrigerant flow between heating and cooling modes for supplying heat from the indoor heat exchanger, wherein:

refrigerant temperature detection means of the outdoor heat exchanger and outdoor air temperature detection means are provided for determining a state of a frost formed on the outdoor heat exchanger;

two types of defrosting inhibition time values τ1 and τ3 are allowed to be set in accordance with a previous defrosting time τ2 for continuously performing heating operation; and a defrosting operation is performed by controlling the defrosting inhibition time values to be long, when an amount of the frost formed on the outdoor heat exchanger is determined to be small, and the defrosting inhibition time values to be short when the amount of the frost formed on the outdoor heat exchanger is determined to be large; wherein the two types of defrosting inhibition time values τ1 and τ3 are correlated to establish a relationship of $\tau 1 \geqq \tau 3$;

when the amount of frost formed on the outdoor heat exchanger is determined to be small, a determination with respect to switching to a defrosting operation is made based on an outdoor pipe temperature corresponding to a refrigerant temperature of the outdoor heat exchanger and the defrosting inhibition time τ1; and when the amount of frost formed on the outdoor heat exchanger is determined to be large, a determination with respect to switching to a defrosting operation is made based on the outdoor pipe temperature, an outdoor air temperature and the defrosting inhibition time value $\tau 3$.

7. The refrigerating air conditioning system according to claim 6, wherein a medium pressure receiver is provided between the indoor heat exchanger and the first pressure reducing device, and a second pressure reducing device is provided between the indoor heat exchanger and the medium pressure receiver.

* * * * *

UNITED STATES PATENT AND TRADEMARK OFFICE

CERTIFICATE OF CORRECTION

PATENT NO. : 7,856,836 B2
APPLICATION NO. : 11/662519
DATED : December 28, 2010
INVENTOR(S) : Masanori Aoki It is certified that error appears in the above-identified patent and that said Letters Patent is hereby corrected as shown below:

Title page Item (86) PCT No.:, change "PCT/JP2006/014541" to --PCT/JP2006/314541--.

Signed and Sealed this
Seventh Day of June, 2011

David J. Kappos

David J. Kappos
*Director of the United States Patent and Trademark Office*